US005152913A

United States Patent [19]

Desbiendras et al.

[11] Patent Number: 5,152,913

[45] Date of Patent: Oct. 6, 1992

[54] CLEANING COMPOSITION BASED ON 1,1-DICHLORO-1-FLUOROETHANE, METHYL FORMATE AND METHANOL

[75] Inventors: Daniel Desbiendras, Villentaneuse; Jean-Jacques Martin, Bois-Colombes; Pascal Michaud, Saint-Gratien, all of France

[73] Assignee: Societe Atochem, Puteaux, France

[21] Appl. No.: 651,814

[22] Filed: Feb. 7, 1991

[30] Foreign Application Priority Data

Feb. 7, 1990 [FR] France ..... 9001396

[51] Int. Cl.[5] ..... C11D 7/30; C11D 7/50; C23G 5/028

[52] U.S. Cl. ..... 252/171; 134/12; 134/31; 134/38; 134/39; 134/40; 252/153; 252/162; 252/170; 252/364; 252/DIG. 9

[58] Field of Search ..... 252/153, 162, 170, 171, 252/172, 364, DIG. 9; 134/12, 31, 38, 39, 40

[56] References Cited

U.S. PATENT DOCUMENTS

| | | | |
|---|---|---|---|
| 2,101,993 | 2/1937 | Fleischer | 252/67 |
| 3,607,755 | 9/1971 | Murphy et al. | 252/67 |
| 3,914,191 | 10/1975 | Scott | 264/53 |
| 4,483,917 | 11/1984 | Archer et al. | 252/172 |
| 4,804,493 | 2/1989 | Gorski | 252/172 |
| 4,816,174 | 3/1989 | Lund et al. | 252/171 |
| 4,836,947 | 6/1989 | Lund et al. | 252/171 |
| 4,842,764 | 6/1989 | Lund et al. | 252/171 |
| 4,945,119 | 7/1990 | Smits et al. | 521/131 |
| 4,960,804 | 10/1990 | Doerge | 521/130 |

FOREIGN PATENT DOCUMENTS

| | | |
|---|---|---|
| 116343 | 2/1984 | European Pat. Off. . |
| 325265 | 1/1989 | European Pat. Off. . |
| 1-132814 | 5/1989 | Japan . |
| 1-139780 | 6/1989 | Japan . |
| WO9113966 | 2/1991 | World Int. Prop. O. . |

OTHER PUBLICATIONS

Chem. Abstr., vol. 95, 1981, p. 693, Abstract No. 42331a.

*Primary Examiner*—Paul Lieberman
*Assistant Examiner*—Linda D. Skaling
*Attorney, Agent, or Firm*—Morgan & Finnegan

[57] ABSTRACT

For replacing cleaning compositions based on 1,1,2-trichloro-1,2,2-trifluoroethane (F113), the invention provides a composition comprising 55 to 79.5% by weight of 1,1-dichloro-1-fluoroethane (F141b), 20 to 40% by weight of methyl formate and 0.5 to 5% of methanol. These three compounds form a positive azeotrope (b.p.=28.3° C. at atmospheric pressure).

The composition, which may be stabilized, can be used for cleaning solid surfaces, in particular for removing flux from printed circuits and for degreasing mechanical parts.

7 Claims, No Drawings

CLEANING COMPOSITION BASED ON 1,1-DICHLORO-1-FLUOROETHANE, METHYL FORMATE AND METHANOL

FIELD OF THE INVENTION

The present invention relates to the area of chlorofluorinated hydrocarbons and more particularly to a novel composition exhibiting an azeotrope which can be used as a cleaning and degreasing agent for solid surfaces, in particular for removing flux and low-temperature cleaning of printed circuits.

BACKGROUND OF THE INVENTION 1,1,2-Trichloro-1,2,2-trifluoroethane (known in the art under the name F113) is widely used in industry for cleaning and degreasing solid surfaces. Apart from its application in electronics for cleaning soldering fluxes to remove any flux still adhering to the printed circuits, its application in degreasing heavy metal parts and for cleaning high-quality, high-precision mechanical parts, such as, for example, gyroscopes and military or aerospace equipment may be mentioned. In its various applications, F113 is most often combined with other organic solvents (for example methanol), preferably in the form of azeotropic or pseudoazeotropic mixtures which do not separate and when being refluxed have essentially the same composition in the vapor phase as in the liquid phase.

However, F113 is one of the completely halogenated chlorofluorocarbons which are currently suspected of attacking and decomposing stratospheric ozone.

DESCRIPTION OF THE INVENTION

As a contribution to solving this problem, the present invention proposes to replace the compositions based on F113 by a novel composition based on methyl formate, methanol and 1,1-dichloro-I-fluoroethane. The latter compound, known in the art under the name F141b, is virtually devoid of any destructive effect with respect to ozone.

The composition to be used according to the invention comprises 55 to 79.5% by weight of F141b, 20 to 40% of methyl formate and 0.5 to 5% of methanol. This range gives rise to an azeotrope whose boiling temperature is 28.3° C. at standard atmospheric pressure (1.013 bar), while the composition according to the invention has pseudoazeotropic behavior, i.e. the composition of the vapor phase and liquid phase is essentially the same, which is particularly advantageous for the intended applications. Preferably, the F141b content is chosen from between 65 and 75% by weight, that of methyl formate from between 24 and 31.5% by weight, and that of methanol from between 1 and 3.5% by weight.

The F141b/methyl formate/methanol azeotrope is a positive azeotrope, since its boiling point (28.3° C.) is below that of the constituents (F141b : 32° C.; methyl formate : 31.7° C.; methanol : 65° C.).

Similarly to the known compositions based on F113, the composition according to the invention can be advantageously stabilized against hydrolysis and/or attack by free radicals, which are likely to occur during the cleaning process, by adding a conventional stabilizer, such as, for example, nitromethane, propylene oxide or a mixture of the compounds, the proportion of the stabilizer ranging from 0.01 to 5%, relative to the total weight of F141b +methyl formate + methanol.

The composition according to the invention can be used for the same applications and using the same techniques as the former compositions based on F113.

EXAMPLES The examples which follow illustrate the invention without limiting it.

EXAMPLE 1 : DETECTION OF THE AZEOTROPE 90g of methyl formate, 60g of methanol and 150g of F141b are introduced in the bottom of a distillation column (30 plates). The mixture is then refluxed for one hour to bring the system to equilibrium. After reaching a steady temperature (28.3° C.), a fraction (about 50g) is removed and analyzed by gas-phase chromatography.

The test results shown in the table below indicate the presence of an F141b/methyl formate/methanol azeotrope.

| | COMPOSITION (% by weight) | | |
|---|---|---|---|
| | F141b | $HCOOCH_3$ | Methanol |
| Initial mixture | 50 | 30 | 20 |
| Fraction removed | 69.8 | 28.1 | 2.1 |

EXAMPLE 2 : VERIFICATION OF THE AZEOTROPIC COMPOSITION 200g of a mixture comprising 70% by weight of F141b, 7.5% by weight of methyl formate and 2.5% by weight of methanol are introduced into the boiler of an adiabatic distillation column (30 plates). The mixture is then refluxed for one hour to bring the system to equilibrium, and a fraction of about 50g is then removed and it is then analyzed by gas-phase chromatography. The results listed in the table below show the presence of a positive azeotrope, since its boiling point is below that of the pure constituents: F141b, methyl formate, and methanol.

| | COMPOSITION (% by weight) | | |
|---|---|---|---|
| | F141b | $HCOOCH_3$ | Methanol |
| Initial mixture | 70 | 27.5 | 2.5 |
| Fraction collected | 69.8 | 28.1 | 2.1 |

Boiling temperature corrected for 1.013 bar: 28.3° C.

When employed for cleaning soldering flux or degreasing mechanical parts, this azeotrope gives results which are as good as those of the compositions based on F113 and methanol.

EXAMPLE 3: COMPOSITION STABILIZED WITH NITROMETHANE 150g of a mixture containing 69.7% by weight of F141b, of methyl formate, 2.1% of methanol and 0.1% of nitromethane as stabilizer is introduced into an ultrasound cleaning bath. After the system has been refluxed for one hour, one aliquot of the vapor phase is removed. Its analysis by gas-phase chromatography shows the presence of nitromethane, which indicates that the mixture is stabilized in the vapor phase.

| | COMPOSITION (% by weight) | | | |
|---|---|---|---|---|
| | F141b | $HCOOCH_3$ | Methanol | $CH_3NO_2$ |
| Initial mixture | 69.7 | 28.1 | 2.1 | 0.1 |

-continued

| | COMPOSITION (% by weight) | | | |
|---|---|---|---|---|
| | F141b | $HCOOCH_3$ | Methanol | $CH_3NO_2$ |
| Vapor phase | 69.79 | 28.1 | 2.1 | 0.01 |

EXAMPLE 4: COMPOSITION STABILIZED WITH PROPYLENE OXIDE

Example 3 is repeated, replacing the nitromethane by propylene oxide, to give the following results:

| | COMPOSITION (% by weight) | | | |
|---|---|---|---|---|
| | F141b | $HCOOCH_3$ | Methanol | $C_3H_6O$ |
| Initial mixture | 69.7 | 28.1 | 2.1 | 0.1 |
| Vapor phase | 69.73 | 28.1 | 2.1 | 0.07 |

EXAMPLE 5: BISTABILIZED COMPOSITION

Example 3 is repeated, using 0.1% of nitromethane and 0.1% of propylene oxide, to give the following results:

| | COMPOSITION (% by weight) | | | | |
|---|---|---|---|---|---|
| | F141b | $HCOOCH_3$ | Methanol | $CH_3NO_2$ | $C_3H_6O$ |
| Initial mixture | 69.7 | 28 | 2.1 | 0.1 | 0.1 |
| Vapor phase | 69.73 | 28.1 | 2.1 | 0.01 | 0.06 |

EXAMPLE 6: CLEANING-OFF OF SOLDERING FLUX 200g of the azeotropic F141b/methyl formate/methanol composition are introduced into an Annemasse ultrasonic bath, and the mixture is then brought to the boiling temperature.

Glass plates which are coated with soldering flux and have been heated in an oven at 220° C. for 30 seconds are immersed in the boiling ultrasonic liquid for 3 minutes and then rinsed in the vapor phase for 3 minutes.

After drying in air, inspection using low-angle illumination reveals a complete absence of any residual soldering flux. Thus, the same result was obtained as when using an F113/methanol (93.7%/6.3%) composition.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. An azeotropic cleaning composition consisting essentially of 55 to 79.5% by weight of 1,1-dichloro-1-fluoroethane, 20 to 40% by weight of methyl formate, and 0.5 to 5% by weight of methanol said composition boiling at about 28.3° C. at atmosphere pressure.

2. Composition according to claim 1, consisting essentially of 65 to 75% by weight of 1,1-dichloro-1-fluoroethane, 24 to 31.5% by weight of methyl formate, and 1 to 3.5% by weight of methanol.

3. Composition according to claim 1, wherein an effective amount of at least one stabilizer is present.

4. Composition according to claim 3, wherein the stabilizer is nitromethane, propylene oxide or a mixture of these compounds.

5. Composition according to claim 3, wherein the proportion of stabilizer is 0.01 to 5% relative to the total weight of 1,1-dichloro-1-fluoroethane, methyl formate, and methanol.

6. Method of cleaning a solid surface comprising contacting said surface with an effective amount of a cleaning composition according to claim 1 for cleaning solid surfaces.

7. Method according to claim 6 wherein said surface is a printed circuit or a mechanical part.

* * * * *

UNITED STATES PATENT AND TRADEMARK OFFICE

CERTIFICATE OF CORRECTION

PATENT NO. : 5,152,913
DATED : October 6, 1992
INVENTOR(S) : Desbiendras, et al

It is certified that error appears in the above-indentified patent and that said Letters Patent is hereby corrected as shown below:

In column 2, Example2, line 2, change "7.5%" to --27.5% --.

In column 2, Example3, line 2, after "F141b," add --28.1% --.

Signed and Sealed this

Twenty-sixth Day of October, 1993

*Attest:*

*Attesting Officer*

Bruce Lehman

BRUCE LEHMAN

*Commissioner of Patents and Trademarks*